US006265957B1

(12) United States Patent
Baginski et al.

(10) Patent No.: US 6,265,957 B1
(45) Date of Patent: Jul. 24, 2001

(54) ELECTROMAGNETIC ACTUATOR EQUIPPED WITH TWO RETURN SPRINGS

(75) Inventors: Pierre Baginski, Grenoble; Daniel Rota, Vif, both of (FR)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/625,500

(22) Filed: Jul. 26, 2000

(30) Foreign Application Priority Data

Sep. 15, 1999 (FR) ..... 99 11696

(51) Int. Cl.[7] ..... H01F 5/00; H01F 3/00

(52) U.S. Cl. ..... 335/266; 335/251; 335/255; 335/258

(58) Field of Search ..... 335/251, 255, 335/259, 261–264, 266, 267, 268; 251/129.01–129.15

(56) References Cited

U.S. PATENT DOCUMENTS

| | | | | |
|---|---|---|---|---|
| 3,988,706 | | 10/1976 | Springer | 335/264 |
| 5,287,939 | | 2/1994 | Fernandez | 180/53.1 |
| 5,708,355 | * | 1/1998 | Schrey | 335/255 |
| 6,091,314 | * | 7/2000 | Wright et al. | 335/220 |
| 6,175,292 | * | 1/2001 | Gruden | 335/267 |

FOREIGN PATENT DOCUMENTS 0 501 695 A1 9/1992 (EP) .

* cited by examiner

*Primary Examiner*—Lincoln Donovan
*Assistant Examiner*—Tuyen T. Nguyen
(74) *Attorney, Agent, or Firm*—Parkhurst & Wendel, LLP

(57) ABSTRACT

An electromagnetic actuator comprises a fixed magnetic circuit made of ferromagnetic material and a movable assembly designed to slide axially between a rest position and an active position. Two return springs bias the movable assembly to its rest position, the second spring having a greater stiffness than the first one. An excitation circuit generates a magnetic flux which is designed, in inrush mode, to move the movable assembly from its rest position to its active position and, in holding mode, is sufficient to hold the movable assembly in the active position. In a first part of the axial travel of the movable assembly from its rest position to its active position, the action of the first spring is preponderant, whereas in the remaining travel up to the active position, the action of the second spring is preponderant.

4 Claims, 6 Drawing Sheets

STATE OF THE TECHNIQUE

ELECTROMAGNETIC ACTUATOR EQUIPPED WITH TWO RETURN SPRINGS

BACKGROUND OF THE INVENTION

The invention relates to an electromagnetic actuator, in particular for a trip device of an electrical switchgear apparatus.

FIG. 7 represents a known actuator of the state of the technique. This actuator 110 comprises a fixed magnetic circuit 112, made of ferromagnetic material, formed by a shell closed at one of its ends on a fixed core 122. A movable assembly 114 is designed to slide parallel to a fixed geometrical axis and comprises a mobile core 116 and a rod 118 associated to the mobile core and passing axially through an opening of the fixed core 122. A spiral-wound compression spring 140 biases the movable assembly 114 to a rest position.

A coiled winding with two fixed coils 130, 132 is fitted inside the shell and surrounds the mobile core 16. This coiled winding is designed to generate a magnetic control flux in the magnetic circuit so as to move the movable assembly towards the fixed core against the action of the spring 140 to an active position.

Such a device is conventionally used in shunt releases (MX) and as closing electromagnet (XF) of a circuit breaker. In case of actuation of the electromagnet, an inrush current flowing in the two coils 130, 132 causes movement of the mobile core 116, and consequently of the rod 118, which then protrudes outwards thus enabling either opening of the associated circuit breaker in the case of a shunt release (MX) or closing of the circuit breaker in the case of a closing electromagnet (XF). It is therefore the electromagnetic energy supplied by the coils 130, 132 during the inrush phase which causes actuation of the circuit breaker. In other words, the rod 118 must be able to perform the mechanical work necessary for movement of the latch to which it is associated, this work corresponding to the energy supplied by the coils 130, 132 in the inrush phase. The inrush phase is followed by a holding phase during which only one of the two coils 130, 132 is supplied. A minimum axial air-gap is maintained by fitting a spacer 141 between the mobile core and the fixed core. When the voltage is lower than a dropout threshold, the current flow in the coil winding is interrupted and the mobile core 116 is separated from the fixed core by the action of the spring 140. As switching to this position does not have any action on the circuit breaker, the power of the spring is relatively indifferent in this phase. The spacer 141 prevents the mobile core 116 from remaining "stuck" to the fixed core 122 due to the remanence effect of the magnetic circuit when the power supply to the coil is interrupted.

In a device of this kind, the dimensioning of the different elements, in particular of the spring and the minimum air-gap in the active position, is difficult. The potential energy of the contracted spring, which has to return the movable assembly to the rest position on its own, must be great enough to overcome the remanent magnetic energy. The presence of the air-gap enables the sticking effect to be limited but induces a risk of nuisance unsticking, i.e. of an involuntary return to the rest position, in particular in response to a mechanical shock on the rod or a large vibration of the movable assembly. If it is chosen to reduce the air-gap, the potential energy of the return spring then has to be increased accordingly, so that the inrush energy necessary to move the movable assembly to the active position is also increased.

OBJECT OF THE INVENTION

The object of the invention is to overcome these shortcomings and to provide a high-sensitivity electromagnetic actuator, of reduced volume and with a low inrush and holding energy, which in addition has a low sensitivity to mechanical shocks and vibrations. According to the invention, this object is achieved by an electromagnetic actuator comprising:

- a fixed magnetic circuit made of ferromagnetic material comprising:
  - a shell and
  - a fixed core situated at one end of the shell and connected thereto,
- a movable assembly designed to slide along a fixed geometric axis between a rest position and an active position and designed to produce a mechanical work when moving from its rest position to its active position, the movable assembly comprising:
  - a mobile core whose axial air-gap with the fixed core is reduced when the movable assembly moves from its rest position to its active position, the axial air-gap between the mobile core and the fixed core being zero in the active position,
  - an actuating means associated to the mobile core,
- a first return spring biasing the movable assembly to its rest position,
- an excitation circuit comprising at least one fixed control coil designed to generate a magnetic control flux in the magnetic circuit, which flux oppose s the action of the first spring, the excitation circuit being designed to switch from an inrush mode in which it delivers a high power sufficient to move the movable assembly from its rest position to its active position, to a holding mode in which it delivers a lower power sufficient to hold the movable assembly in the active position,
- a second spring with a greater stiffness than that of the first spring, designed to return the movable assembly flexibly to its rest position,
- a first stop,
- a second stop, mobile and designed to operate in conjunction at least with the second spring and with the first stop, in such a way that, in a first part of the axial travel of the movable assembly from its rest position to its active position, the second stop is not in contact with the first stop and the action of the first spring is preponderant, and that in the remaining travel up to the active position, the second stop is immobilized with respect to the first stop and the action of the second spring is preponderant.

During the first phase of activation, the effect of the spring with lesser stiffness is preponderant, so that the movable assembly is subjected to a large acceleration. At the end of the first phase, the kinetic energy stored by the movable assembly is great. In addition the axial air-gap is reduced, so that during the second phase of activation contraction of the second spring is possible. The zero air-gap between the mobile core and the fixed core contributes to decreasing the supply energy of the coil necessary to hold the actuator in the active position and ensures a better resistance to mechanical shocks and vibrations. At the moment the movable assembly returns to the rest position, the increase of the magnetic remanence effect resulting from the absence of an air-gap is compensated by the second spring.

According to a preferred embodiment, the first spring is arranged between the fixed core and the movable stop, and the second spring is arranged between the movable stop and the movable assembly, so that in the first part of the travel, the two springs cooperate in series, and that in the second part of the travel, only the second spring continues to work. If $k_1$ is the stiffness of the first spring and $k_2$ that of the second spring, the stiffness of the system in the first phase is $k_1k_2/(k_1+k_2)$, a value which will be all the more close to $k_1$ the greater $k_2$ is compared with $k_1$. During the second phase, the stiffness of the system is equal to $k_2$. This series fitting is particularly advantageous when the radial dimensions of the actuator and the diameter of the coil are sought to be reduced as a priority.

According to another embodiment, the first spring is arranged between the fixed core and the movable assembly whereas the second spring is arranged between the fixed core and the second stop, so that in the first part of the travel the first spring is working alone, and that in the second part of the travel the two springs are cooperating in parallel. The stiffness in the first phase is then equal to $k_1$ and the stiffness in the second phase is equal to $k_1+k_2$, a value all the more close to $k_2$ the greater $k_2$ is compared with $k_1$. This arrangement, which in practice requires a greater radial dimension, and therefore bulkier coils for a given number of turns, does however enable the axial dimensions of the actuator to be reduced, which can be advantageous in certain cases.

Preferably the ratio $k_1/k_2$ is less than 1/10, for example about 1/20. It is clear that the movement/force characteristic that can be obtained with two springs is more clear-cut than that which a single spring of variable stiffness would be able to offer, which provides the best possible answer to the non-linearity and remanence of the magnetic circuit, implementing inexpensive standard parts only.

BRIEF DESCRIPTION OF THE DRAWINGS

Other advantages and features of the invention will become more clearly apparent from the following description of different embodiments of the invention given as nonrestrictive examples only and represented in the accompanying drawings in which.

DETAILED DESCRIPTION OF THE PREFERRED EMBODIMENTS

Figure 1:
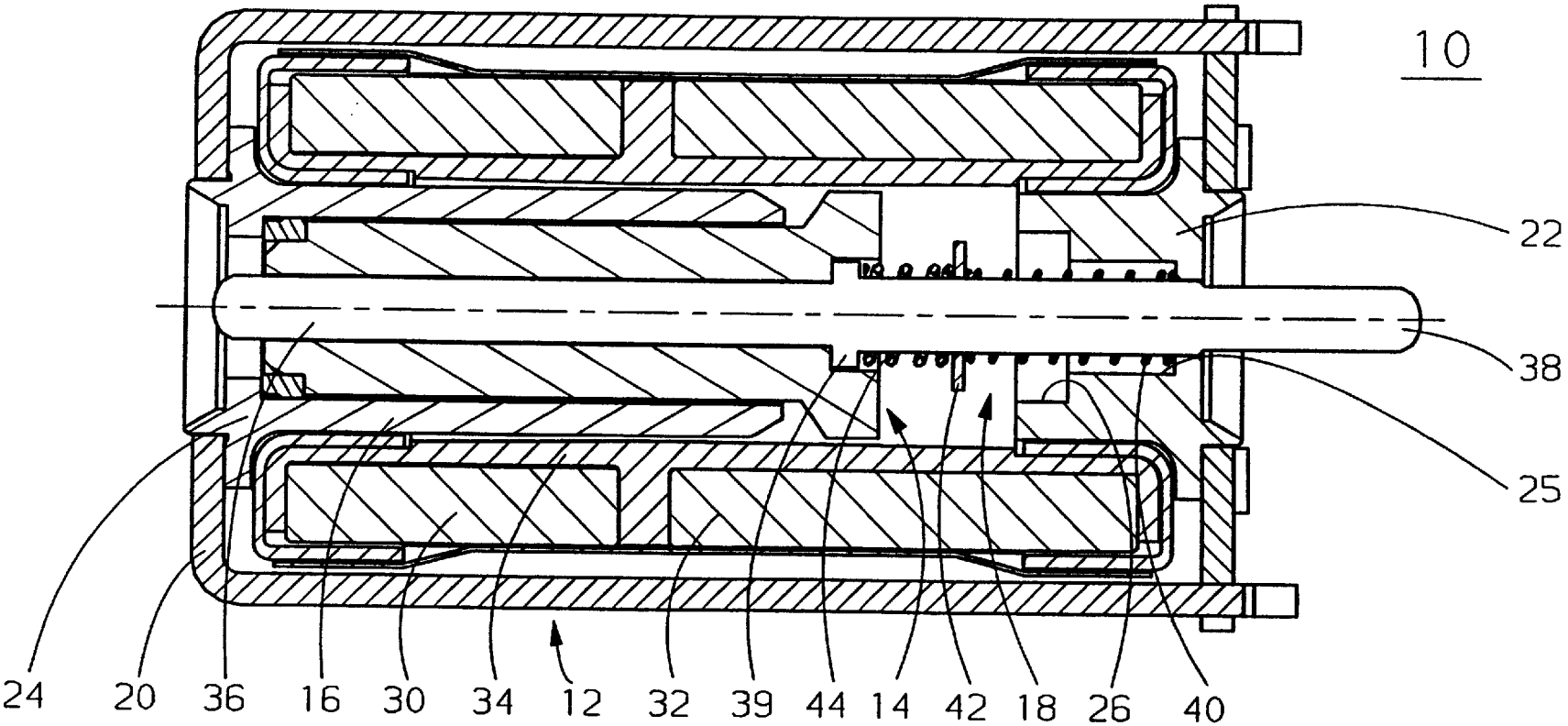
FIG. 1 represents a cross-sectional view of an actuator according to a first embodiment of the invention, in the rest position.
Figure 2:
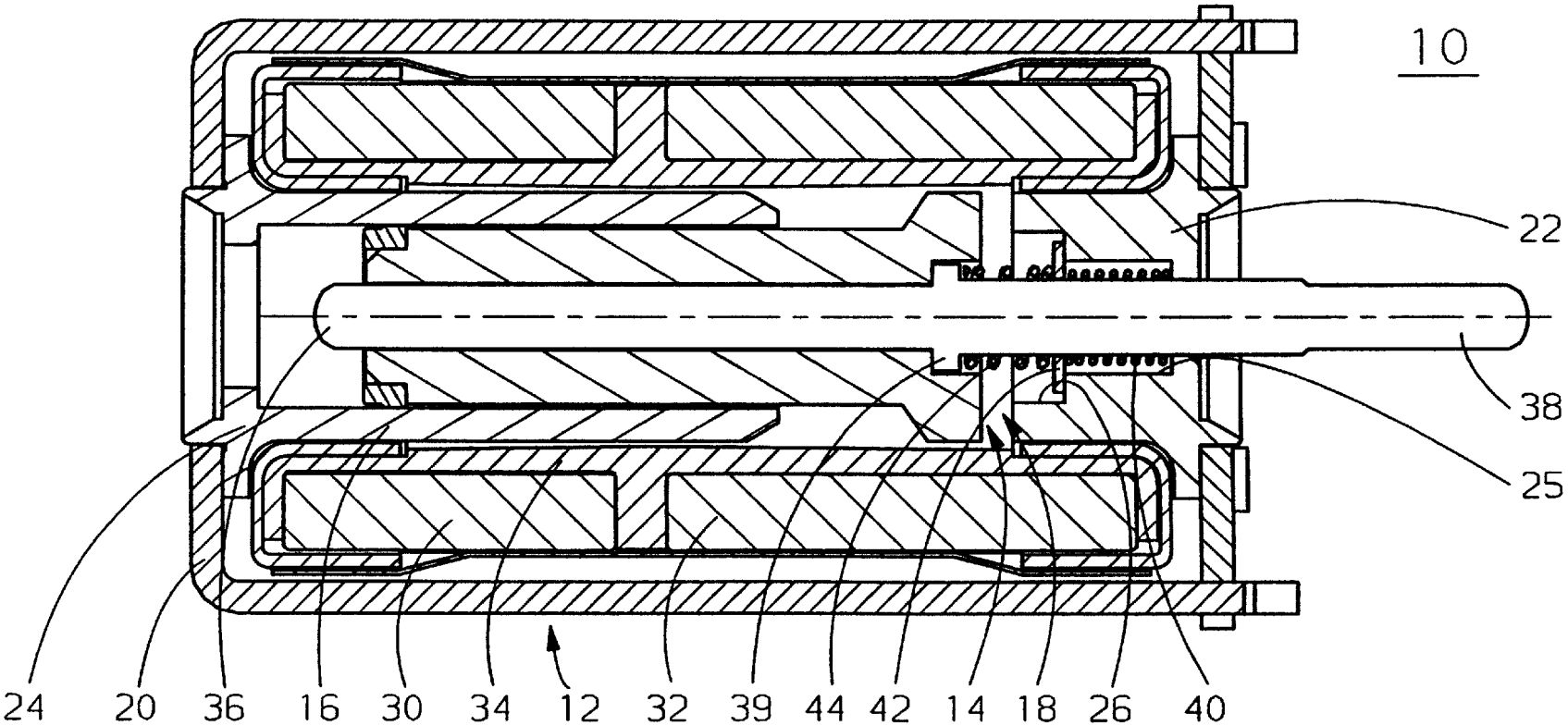
FIG. 2 represents the actuator according to the first embodiment of the invention, in the intermediate position.
Figure 3:
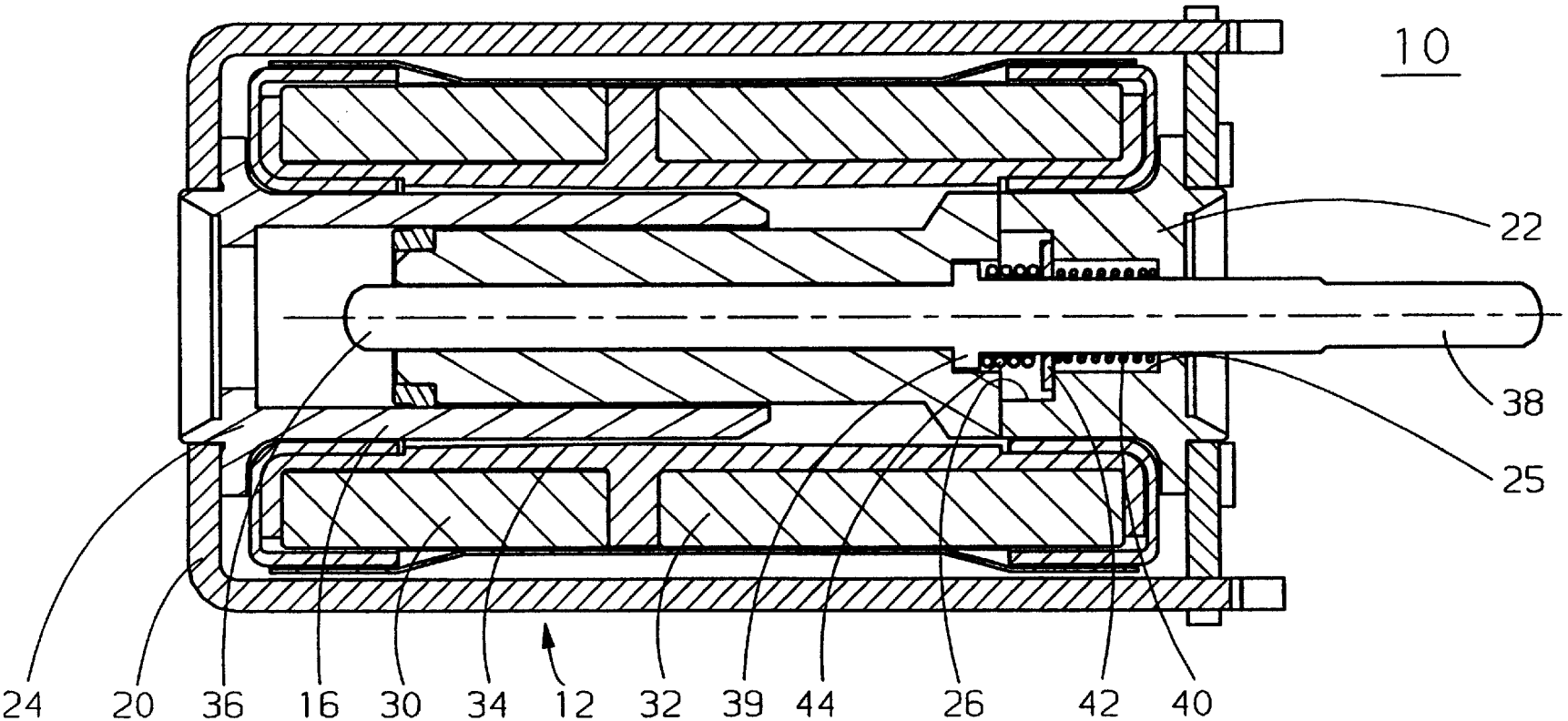
FIG. 3 represents the actuator according to the first embodiment of the invention, in the active position.

With reference to FIGS. 1 to 3, a high-sensitivity electromagnetic actuator 10 for an electrical circuit breaker comprises a non-polarized fixed magnetic circuit 12 operating in conjunction with a movable assembly 14 formed by a sliding mobile core 16 associated to an actuating means 18 made of non-magnetic material.

The magnetic circuit is formed by a ferromagnetic shell 20 in the form of a frame closing on one side on a fixed core 22 made of ferromagnetic material and on the opposite side on a tubular sheath 24 made of ferromagnetic material extending axially towards the inside of the shell 20 and surrounding a part of the mobile core 16 with interposition of a uniform radial air-gap. The fixed core 22 comprises a pass-through axial bore broadening out towards the inside of the shell into a first recess 25 and a second recess 26.

Two control coils 30, 32 are fitted coaxially end to end in a cylindrical sheath 34 made of insulating material inside the shell 20.

The actuating means 18 is formed by a securing rod 36 and a push-rod 38 arranged axially in the extension of one another and separated by a collar 39.

The tubular sheath 24 and the bore of the fixed core 22 determine a geometric axis for guiding the movable assembly. The mobile core 16 slides axially inside the sheath 24 between a rest position and an active position. The mobile core is provided with an axial pass-through bore for housing the securing rod 36 of the actuating means 18. The bore of the mobile core forms a bearing, on the side facing the fixed core 22, acting as seat for the collar 39 of the actuating means 18.

The push-rod 38 extends outside the shell through the fixed core 22. The bore of the fixed core 22 forms an axial guiding for the push-rod 38. The push-rod 38 is designed to operate, directly or by means of a striker engaged in its end, in conjunction with a latch (not represented) of a circuit breaker mechanism.

The first recess 25 of the fixed core 22 forms a seat on which one end of a first compression return spring 40 bears and a housing for the spring 40. The other end of the spring 40 bears on a washer 42 free to move axially on the push-rod 38. The second recess 26 of the fixed core 22 forms a bearing for the washer 42 between the intermediate position of FIG. 2 and the active position of FIG. 3. A second compression spring 44 bears via one end on the collar 39 of the actuating means and via the other end on the washer 42.

The first spring 40 has a stiffness whose value $k_1$ is much lower than the stiffness $k_2$ of the second spring 44. In practice, the ratio $k_1/k_2$ is less than 1/10, for example about 1/20.

Figure 4:
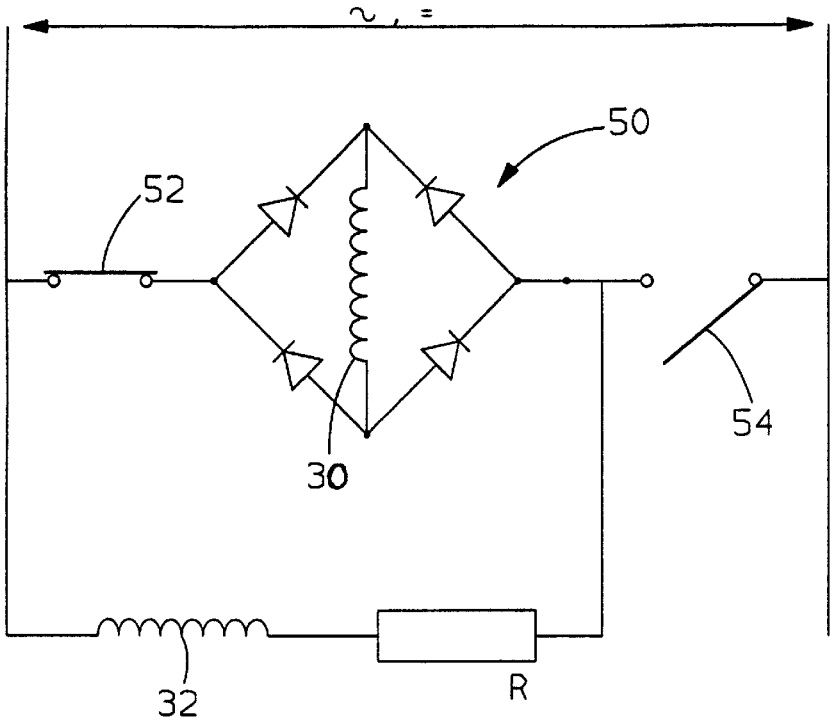
FIG. 4 represents a wiring diagram of an excitation circuit of the actuator according to the first embodiment of the invention.

The two control coils 30, 32 form part of an excitation circuit 48 of known type visible in FIG. 4 and described for example in the document FR-A-2,290,009, with a rectifier bridge with four elements 50, of the Graetz type, enabling power supply to be performed in either DC or AC. A first of the two coils, called the inrush coil 30, made of thick wire, is placed in the diagonal called the DC diagonal of the bridge. The other diagonal is coupled to the DC or AC power supply by means of an isolating contact 52. The other coil, called the holding coil 32, made of fine wire, is connected in parallel on the branch of the circuit formed by the bridge 50 and the isolating contact 52. A general contact 54 conditions power supply of the circuit. The isolating contact 52, closed when the actuator is put into operation and open when the movable assembly has reached a position close to its active position, conditions power supply of the bridge. It can be of any known type, with mechanical or electronic switching, the essential thing being that, as soon as the circuit is put into operation, it closes during the inrush period and opens at the moment when the travel of the mobile core is appreciably completed. The document FR-A-2,290,009 should be referred to for a more precise description of an isolating contact.

Figure 5:
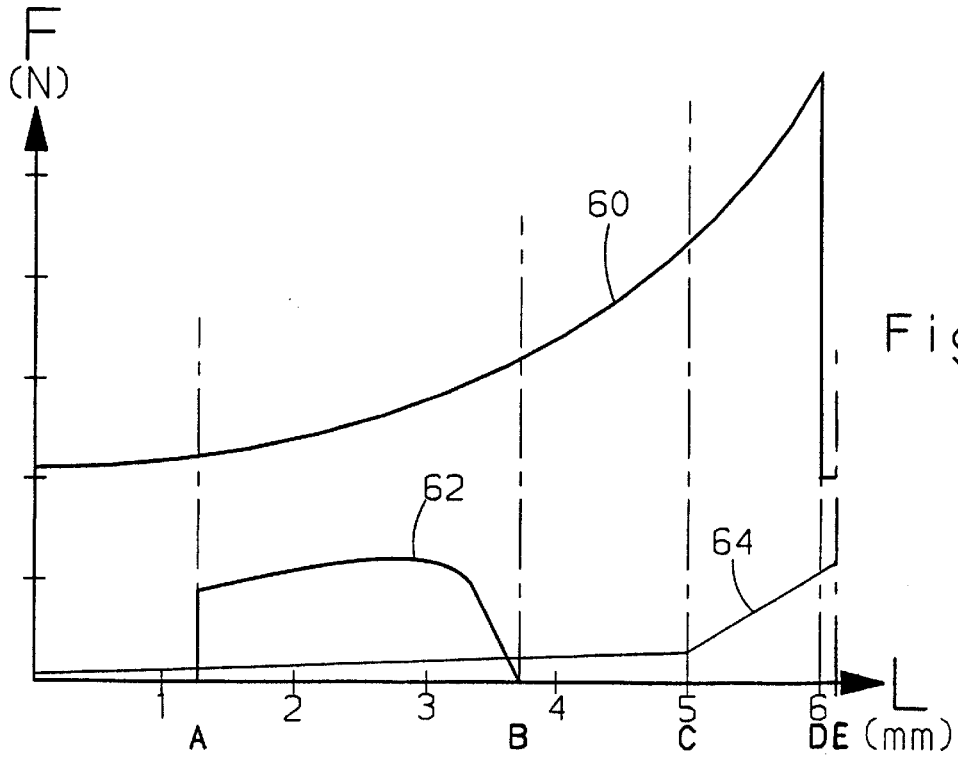
FIG. 5 represents the characteristic curves of the forces in play when the actuator is activated, according to the travel performed.

Operation of the actuator will be described with reference to FIG. 5, which schematizes on the y-axis the electromagnetic force exerted on the mobile core (curve 60), the opposing force of the circuit breaker latch on the striker rod (curve 62) and the resistive action of the springs (curve 64), versus the travel of the movable assembly indicated on the x-axis.

At rest, the main contact 54 is open and the coils 30, 32 are not supplied with power, so that the movable assembly 14 is biased to its rest position represented in FIG. 1 by the combined action of the two springs 40, 44 in series.

Closing of the main contact 54 and of the isolating contact 52 results in power supply of the two coils 30, 32. The magnetic flux generates forces which propel the mobile core 16 to the right in FIGS. 1 to 3. These electromagnetic forces are totally transmitted to the actuating means 18, then to the washer 42 by means of the second spring 44, then to the fixed core 22 by means of the first spring 40. The two springs 40, 44 are subjected to the same forces—if the very small weight of the washer 42 is ignored—but the deformation of the first spring 40 is preponderant with respect to that of the second spring 44 due to the difference of stiffness. The equivalent stiffness of the assembly formed by the two springs in this phase is in fact equal to $k_1k_2/(k_1+k_2)$, a value which will be all the more close to k, the greater $k_2$ is compared with $k_1$.

After a dead travel of about 1 mm up to the abscissa A, the following 2 to 3 mm of travel up to the abscissa B constitute the useful travel during which the end of the push-rod strikes a latch of a mechanism of the circuit breaker and causes pivoting thereof. This latch can be an opening latch if the actuator is integrated in a shunt release (MX), or a closing latch if the actuator is integrated in a closing control (XF). In all cases, it is therefore the electromagnetic energy supplied by the excitation circuit, and possibly for a part the kinetic energy stored during the previous dead travel and transmitted when striking takes place, which bring about the change of state of the latch. In this useful phase, the opposing action of the return spring system 40, 44 is very small due to its low equivalent stiffness.

By continuing its contraction beyond the useful travel described above, up to the abscissa C corresponding to the position represented in FIG. 2, the first spring is then contracted so as to be housed completely in the first recess 25 of the fixed core 22 and the stop washer 42 comes into contact with the bearing formed by the second recess 26. Beyond this position, the behavior of the device changes. Continuation of the movement of the movable assembly 14 to its active position at the abscissa E corresponding to the position represented in FIG. 3 leads to an additional deformation of the second spring 44 only, and the equivalent stiffness of the system is equal to the stiffness $k_2$ of the second spring 44, whence the change of gradient of the curve 64. The axial air-gap between the mobile core 16 and the fixed core 22 is reduced until it is eliminated in FIG. 3. Just before the active position is reached, the isolating contact 52 opens at abscissa D so that only the holding coil 32 remains supplied, generating a sufficient magnetic flux to hold the movable assembly 14 in the active position against the combined force of the first spring 40 and of the second spring 44, the latter now being housed in the second recess 26.

When opening of the main contact 54 occurs, the potential energy of the second spring 44 is sufficient to cause unsticking of the mobile core 16 in spite of the remanent field in the magnetic circuit 12. The first spring 40 when relaxing supplies the residual mechanical work necessary for the movable assembly 14 to return to its rest position.

Various alternative embodiments are naturally envisageable.

The excitation circuit can take any known form enabling a high power to be applied sufficient to move the movable assembly from its rest position to its active position during an inrush phase, then a lower power to be applied sufficient to hold the movable assembly in the active position during a holding phase. The end of the inrush phase can be automatically loop-locked to the movement of the movable assembly, as described for example in the first embodiment, or not, as described for example in the document FR-A-2,133,652. The windings can be connected in series rather than in parallel, as described in the document FR-A-2,290,010. The excitation difference between the two phases can also be obtained with a single coil, which can be controlled by the mains system power supply during the inrush phase and then in chopped form by a pulse generator in the holding phase.

Figure 6:
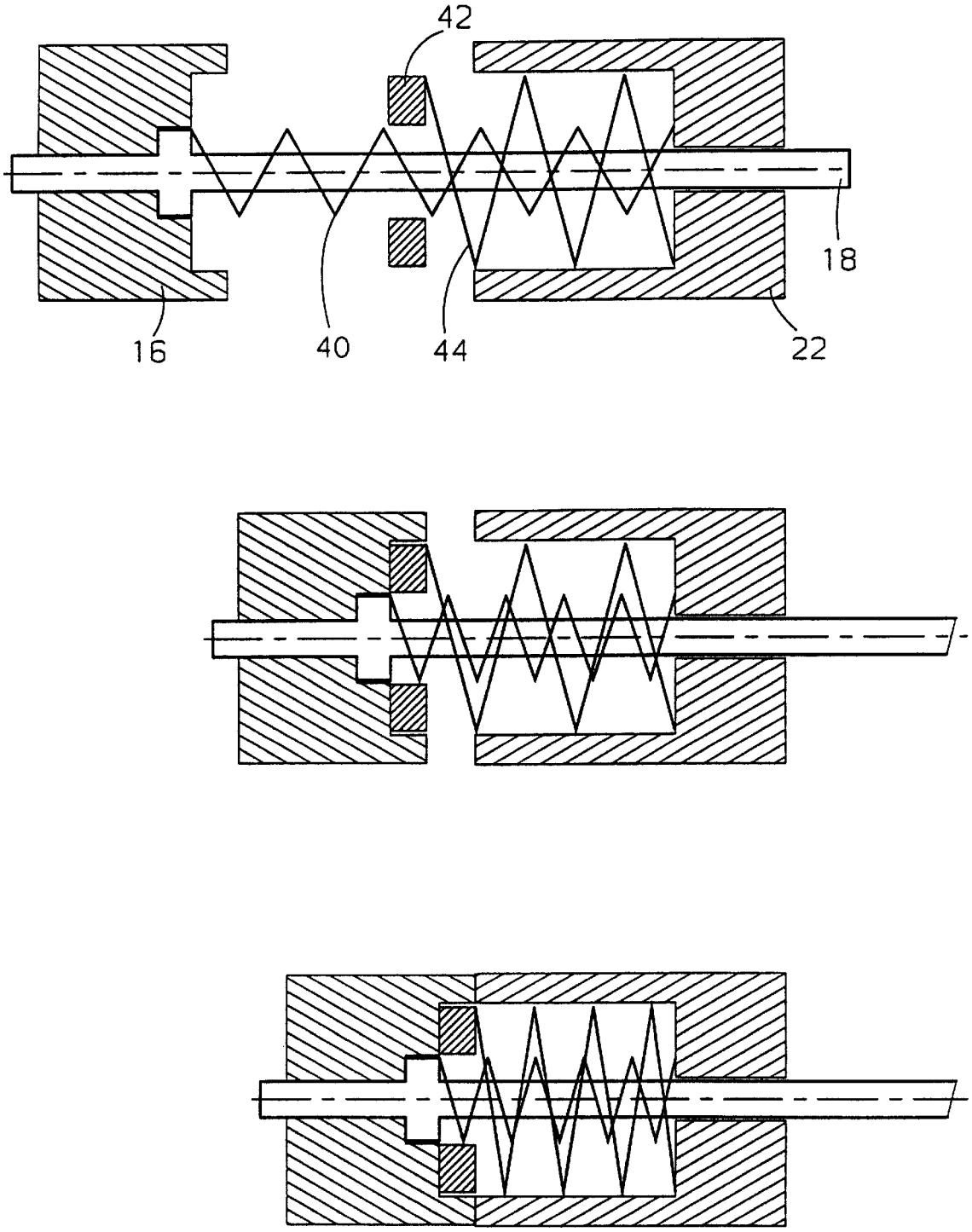
FIG. 6 represents a simplified diagram of a second embodiment of the invention in the rest position, the intermediate position and the active position.
Figure 7:
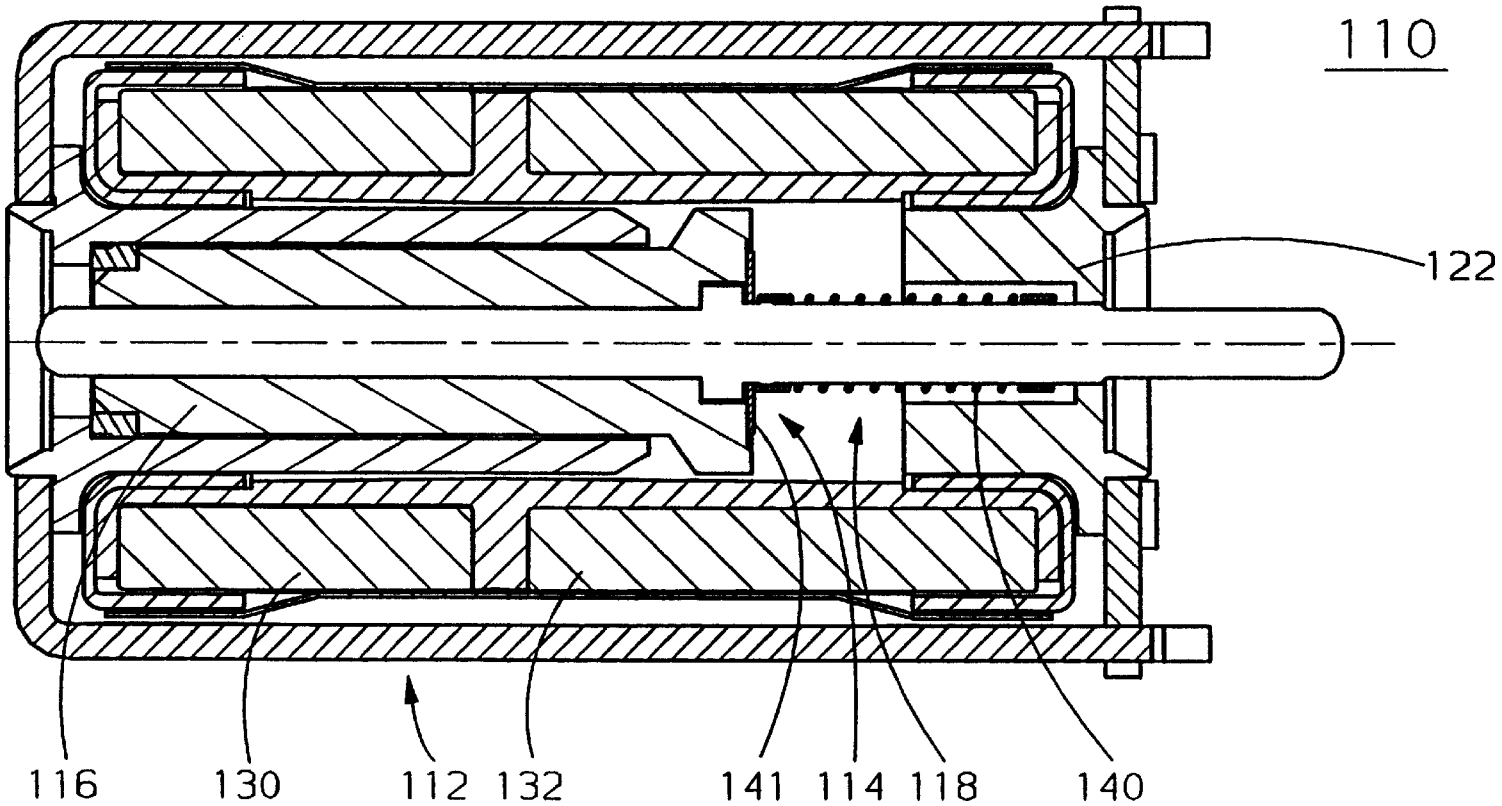
FIG. 7, already commented, represents an actuator of the state of the technique.

Likewise, the two springs can be arranged in different manners to obtain the required differentiation between the first part of the travel during which the assembly formed by the two springs behaves like a spring whose characteristic is approximately or exactly equal to that of the spring having the lower stiffness, and the second part of the travel during which the assembly formed by the two springs behaves like a spring whose characteristic is approximately or exactly equal to that of the spring having the higher stiffness. FIG. 6 schematically represents an alternative embodiment, in the rest position, in the intermediate position, and in the active position. The spring having the lower stiffness 40 is the only one to be working during the first part of the travel, whereas during the second part of the travel both the springs 40, 44 are working in parallel, with an equivalent stiffness $k_1+k_2$ which is all the more close to $k_2$ the greater $k_2$ is compared with $k_1$. The washer 42 acts as a mobile stop and operates in conjunction with a stop formed by a recess of the mobile core 16.

What is claimed is:

1. An electromagnetic actuator comprising:

a fixed magnetic circuit made of ferromagnetic material comprising:

a shell and a fixed core situated at one end of the shell and connected thereto, a movable assembly designed to slide along a fixed geometric axis between a rest position and an active position and designed to produce a mechanical work when moving from its rest position to its active position, the movable assembly comprising:

a mobile core whose axial air-gap with the fixed core is reduced when the movable assembly moves from its rest position to its active position, an actuating means associated to the mobile core, a first return spring biasing the movable assembly to its rest position, an excitation circuit comprising at least one fixed control coil designed to generate a magnetic control flux in the magnetic circuit, which flux opposes the action of the first spring, the excitation circuit being designed to switch from an inrush mode in which it delivers a high power sufficient to move the movable assembly from its rest position to its active position, to a holding mode in which it delivers a lower power sufficient to hold the movable assembly in the active position, wherein in the active position, the axial air-gap between the mobile core and the fixed core is zero and the actuator comprises in addition:

a second spring with a greater stiffness than that of the first spring, designed to return the movable assembly flexibly to its rest position, a first stop, a second stop, mobile and designed to operate in conjunction at least with the second spring and with the first stop, in such a way that in a first part of the axial travel of the movable assembly from its rest position to its active position, the second stop is not in contact with the first stop and the action of the first spring is preponderant, and that in the remaining travel up to the active position, the second stop is immobilized with respect to the first stop and the action of the second spring is preponderant.

2. The actuator according to claim 1, wherein the first spring is arranged between the fixed core and the second stop, and the second spring is arranged between the second stop and the movable assembly, so that in the first part of the travel, the two springs cooperate in series, and that in the second part of the travel, only the second spring continues to work.

3. The actuator according to claim 1, wherein the first spring is arranged between the fixed core and the movable assembly and the second spring is arranged between the fixed core and the second stop, so that in the first part of the travel the first spring is working alone, and that in the second part of the travel the two springs are cooperating in parallel.

4. The actuator according to claim 1, wherein the ratio $k_1/k_2$ is less than $1/10$, for example about $1/20$.

* * * * *